US008727861B2

(12) United States Patent
Schlegel et al.

(10) Patent No.: US 8,727,861 B2
(45) **Date of Patent: *May 20, 2014**

(54) GAMING DEVICE HAVING A RELATED WINNING SYMBOL SELECTION GAME

(75) Inventors: Megan N. Schlegel, Reno, NV (US); Joseph E. Kaminkow, Reno, NV (US); Anthony J. Baerlocher, Reno, NV (US); Randall D. Mead, Reno, NV (US)

(73) Assignee: IGT, Las Vegas, NV (US)

( * ) Notice: Subject to any disclaimer, the term of this patent is extended or adjusted under 35 U.S.C. 154(b) by 1691 days.

This patent is subject to a terminal disclaimer.

(21) Appl. No.: 12/098,808

(22) Filed: Apr. 7, 2008

(65) Prior Publication Data

US 2008/0188287 A1 Aug. 7, 2008

Related U.S. Application Data

(63) Continuation of application No. 10/071,138, filed on Feb. 8, 2002, now Pat. No. 7,413,510.

(51) Int. Cl.
*G07F 17/32* (2006.01)

(52) U.S. Cl.
USPC ..... 463/17; 463/18; 463/20

(58) Field of Classification Search
USPC ..... 463/10, 16, 20, 40
See application file for complete search history.

(56) References Cited

U.S. PATENT DOCUMENTS 3,825,255 A 7/1974 Kennard et al.
4,375,666 A * 3/1983 Buck et al. ..... 463/10
4,695,053 A 9/1987 Vazquez, Jr. et al.
5,046,737 A 9/1991 Fienberg
(Continued)

FOREIGN PATENT DOCUMENTS

AU 2002/27614 12/2002
AU 779572 1/2005
(Continued)

OTHER PUBLICATIONS

Schumin, Ben F., "A Salute to Game Shows," dated 2001, available at http://www.chris-place.com/game-shows/shows/price-is-right/pricing-games.htm, last accessed, Jun. 5, 2013.*
(Continued)

*Primary Examiner* — Dmitry Suhol
*Assistant Examiner* — Jay Trent Liddle
(74) *Attorney, Agent, or Firm* — Neal, Gerber & Eisenberg LLP

(57) ABSTRACT

The present invention relates to a gaming device and method having a bonus game, where the bonus game displays a target set including a plurality of player selectable symbols. At least one of the symbols is designated as a target symbol in a target set. The gaming device provides a predetermined number of picks to begin a bonus game and enables a player to use the picks to pick symbols from the target set. If the player picks a symbol that is not a target symbol, a relationship indicator indicates the relationship between the target symbol and the picked symbol. The player continues to pick symbols in the target set until the player picks the target symbol. If the player picks a target symbol, the gaming device enables the player to pick symbols from a new target set. The player continues to pick symbols in target sets until the player has no picks remaining. Preferably, the gaming device provides an award for each picked target symbol.

36 Claims, 13 Drawing Sheets

(56) References Cited

U.S. PATENT DOCUMENTS

| | | | | |
|---|---|---|---|---|
| 5,092,598 | A | 3/1992 | Kamille | |
| 5,116,049 | A * | 5/1992 | Sludikoff et al. | 273/139 |
| 5,342,047 | A | 8/1994 | Heidel et al. | |
| 5,344,199 | A * | 9/1994 | Carstens et al. | 463/17 |
| 5,647,798 | A | 7/1997 | Falciglia | |
| 5,755,619 | A | 5/1998 | Matsumoto et al. | |
| 5,855,514 | A | 1/1999 | Kamille | |
| 5,902,184 | A | 5/1999 | Bennett et al. | |
| 5,919,088 | A | 7/1999 | Weiss | |
| 5,931,467 | A | 8/1999 | Kamille | |
| 5,997,401 | A | 12/1999 | Crawford | |
| 6,001,016 | A * | 12/1999 | Walker et al. | 463/42 |
| 6,015,346 | A | 1/2000 | Bennett | |
| 6,059,289 | A | 5/2000 | Vancura | |
| 6,089,976 | A | 7/2000 | Schneider et al. | |
| 6,102,400 | A | 8/2000 | Scott et al. | |
| 6,102,798 | A | 8/2000 | Bennett | |
| 6,126,542 | A | 10/2000 | Fier | |
| 6,142,873 | A | 11/2000 | Weiss et al. | |
| 6,159,097 | A * | 12/2000 | Gura | 463/20 |
| 6,159,098 | A * | 12/2000 | Slomiany et al. | 463/25 |
| 6,164,652 | A | 12/2000 | Lauretta et al. | |
| 6,174,235 | B1 | 1/2001 | Walker et al. | |
| 6,176,487 | B1 | 1/2001 | Eklund et al. | |
| 6,186,894 | B1 | 2/2001 | Mayeroff | |
| 6,224,482 | B1 | 5/2001 | Bennett | |
| 6,224,483 | B1 | 5/2001 | Mayeroff | |
| 6,227,969 | B1 | 5/2001 | Yoseloff | |
| 6,231,445 | B1 | 5/2001 | Acres | |
| 6,261,177 | B1 | 7/2001 | Bennett | |
| 6,270,412 | B1 | 8/2001 | Crawford et al. | |
| 6,309,300 | B1 | 10/2001 | Glavich | |
| 6,312,334 | B1 | 11/2001 | Yoseloff | |
| 6,315,662 | B1 | 11/2001 | Jorasch et al. | |
| 6,315,664 | B1 | 11/2001 | Baerlocher et al. | |
| 6,319,124 | B1 | 11/2001 | Baerlocher et al. | |
| 6,322,309 | B1 | 11/2001 | Thomas et al. | |
| 6,346,043 | B1 | 2/2002 | Colin et al. | |
| 6,347,996 | B1 | 2/2002 | Gilmore et al. | |
| 6,354,593 | B1 | 3/2002 | Frommer et al. | |
| 6,398,644 | B1 | 6/2002 | Perrie et al. | |
| 6,413,160 | B1 | 7/2002 | Vancura | |
| 6,439,995 | B1 * | 8/2002 | Hughs-Baird et al. | 463/20 |
| 6,443,837 | B1 | 9/2002 | Jaffe et al. | |
| 6,491,583 | B1 | 12/2002 | Gauselmann | |
| 6,506,117 | B2 | 1/2003 | DeMar et al. | |
| 6,561,902 | B1 | 5/2003 | Walker et al. | |
| 6,575,829 | B2 * | 6/2003 | Coleman et al. | 463/20 |
| 6,589,114 | B2 | 7/2003 | Rose | |
| 6,592,457 | B1 * | 7/2003 | Frohm et al. | 463/16 |
| 6,595,859 | B2 | 7/2003 | Lynn | |
| 6,599,185 | B1 * | 7/2003 | Kaminkow et al. | 463/16 |
| 6,607,437 | B2 | 8/2003 | Casey et al. | |
| 6,800,027 | B2 | 10/2004 | Giobbi et al. | |
| 6,988,732 | B2 | 1/2006 | Vancura | |
| 6,988,948 | B2 * | 1/2006 | Perrie et al. | 463/25 |
| 7,234,700 | B2 | 6/2007 | Vancura | |
| 2001/0038178 | A1 | 11/2001 | Vancura | |
| 2002/0025844 | A1 | 2/2002 | Casey et al. | |
| 2002/0043759 | A1 | 4/2002 | Vancura | |
| 2002/0187827 | A1 | 12/2002 | Blankstein | |
| 2003/0003975 | A1 | 1/2003 | Lynn | |
| 2003/0036419 | A1 | 2/2003 | Baerlocher et al. | |
| 2003/0060266 | A1 | 3/2003 | Baerlocher et al. | |
| 2003/0071416 | A1 | 4/2003 | Vancura | |
| 2004/0036216 | A1 | 2/2004 | Vancura | |
| 2006/0116188 | A1 | 6/2006 | Blankstein | |

FOREIGN PATENT DOCUMENTS

| | | |
|---|---|---|
| AU | 782941 | 9/2005 |
| CA | 2306373 | 10/2000 |
| EP | 0874337 | 10/1998 |
| EP | 0945837 | 9/1999 |
| EP | 0984409 | 3/2000 |
| EP | 1 266 677 | 12/2002 |
| GB | 2144644 | 3/1985 |
| WO | 00/15314 | 3/2000 |
| WO | WO 00/12186 | 3/2000 |

OTHER PUBLICATIONS

A Salute to Game Shows—The Price is Right—Pricing Games printed from website gscentral.net/clock.htm printed on Aug. 16, 2000.

Believe It or Not Article published by Strictly Slots in Jun. 2001.

Bullseye I (The Price Is Right), printed from http://gscentral.net/pricing1.htm on Feb. 7, 2006, available prior to Feb. 2002.

Clock Game (The Price Is Right), printed from http://gscentral.net/pricing1.htm on Feb. 7, 2006, available prior to Feb. 2002.

Clock Game printed from website www:gscentral.net, published in 1972.

Deep Pockets Advertisement, written by IGT, published in 2002.

Deep Pockets Article, written by Strictly Slots, published in 2002.

Dice Game (The Price Is Right), printed from http://gscentral.net/pricing1.htm on Feb. 7, 2006, available prior to Feb. 2002.

Fortune Cookie Brochure written by IGT, published in 2000.

Fortune Hunter Brochure written by Aristocrat, published in 1995.

Penny Ante (The Price Is Right), printed from http://gscentral.net/pricing1.htm on Feb. 7, 2006, available prior to Feb. 2002.

Schwartz, David, Ryan, Steve and Wostbrock, Fred. The Encyclopedia of TV Game Shows. Third Ed. Checkmark Books, New York: 1999 pp. 176-180.

South Park Brochure written by IGT, published in 2000.

Spell Binder Article written by Strictly Slots, published in 2000.

Ten Chances printed from website www.gscentral.net, published in 1975.

The Munsters Article and Website Page written by IGT, published in 2000, printed Mar. 21, 2001.

The Price is Right printed from website www.curtallaiume.com, published on Jul. 18, 2002.

Wheel of Fortune Brochure written by IGT, published in 1998.

Statement of Grounds and Particulars filed in Support of Notice of Opposition, dated Jan. 23, 2009, Australian Application No. 2003200419.

* cited by examiner

GAMING DEVICE HAVING A RELATED WINNING SYMBOL SELECTION GAME

PRIORITY CLAIM

This application is a continuation of and claims the benefit of U.S. patent application Ser. No. 10/071,138, filed Feb. 8, 2002, the entire contents of which are incorporated herein by reference.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

The present invention relates in general to a gaming device, and more particularly to a gaming device having a related symbol selection game.

Gaming device manufacturers strive to make gaming devices that provide as much enjoyment and excitement as possible. Providing a secondary or bonus game in which a player has an opportunity to win potentially large awards or credits in addition to the awards associated with the primary or base game of the gaming device is one way to enhance player enjoyment and excitement.

Gaming devices having a secondary or bonus games generally employ a triggering event that occurs during the base game operation of the gaming device. The triggering event temporarily stalls or halts further base game play and enables a player to enter a second, different game, which is the bonus game. The player plays the bonus game, likely receives a bonus award, and returns to the base game.

Currently, gaming machines or devices such as slot machines provide bonus games wherein a player has one or more opportunities to select one or more symbols from a plurality of possible symbols. If the player selects one of the designated winning symbols or a winning combination of symbols, the game awards the player a bonus value such as credits. The outcome depends upon the particular symbol or symbols obtained by the player. If the player selects a terminating symbol, the game ends.

One known gaming device is the SPELLBINDER™ gaming device. For the bonus game of the SPELLBINDER™ gaming device, the gaming device displays the numbers one to twelve to a player. The gaming device selects one of the numbers from the set of numbers. The gaming device requires the player to input whether the player believes that the next number will be higher or lower than the selected number. If the player picked correctly, the gaming device provides an award to the player and repeats the process. If the player does not pick correctly, the bonus game ends.

Other various bonus games have been associated with gaming machines. Therefore, to increase player enjoyment and excitement, it is desirable to provide new bonus games for gaming machines.

SUMMARY

The present invention provides a gaming device and in particular a secondary or bonus game of a gaming device that includes at least one target set. The target set has a plurality of symbols including at least one symbol which is randomly designated to be the target symbol. The gaming device enables a player to pick symbols from the target set until the player selects the target symbol or runs out of picks. In one embodiment, the player receives a predetermined number of picks when the game begins. After the player picks a symbol, a relationship indicator identifies the relationship between the picked symbol and the target symbol in the target set. If the picked symbol is not (or does not match) the target symbol, the relationship indicator indicates the relationship of the target symbol to the picked symbol. The player continues to pick symbols from the target set until the player obtains the target symbol or runs out of picks. Preferably, the player receives an award for picking the randomly designated target symbol. It should be appreciated that the number of or type of target symbols in each target set may vary. Also, the target symbols may be the same symbols, different symbols or any combination of symbols in each bonus game.

In one embodiment, the gaming device includes a plurality of target sets and provides an award to the player for each picked target symbol in each set. In one embodiment, the player has a total cumulative number of picks the player can use in selecting symbols in all of the target sets. Each target symbol is associated with an award and the player's total award is based on the sum of the individual awards for each picked target symbol. It should also be appreciated that the processor or controller of the gaming device could randomly determine the awards for the target symbols. In accord with one aspect of the invention, each award is associated with a probability of being associated with a target symbol such that one award has a greater probability of being associated with a target symbol than another award.

In another embodiment, the gaming device provides an award to the player based on the target symbols picked by the player. In one such embodiment, the symbols in each target set are numbers, such as the integers from zero to nine, and the target symbol is one of the numbers. When the player picks the target number, the gaming device uses the picked target number to determine the player's award. In one embodiment, the player receives the sum of the awards associated with each picked target symbol in a target set or sets. In an alternative embodiment, the player could receive an award or combined award based on completing an award combination. In this alternative embodiment, the award or combined award is a combination of the target numbers. The combination is formed by placing the target numbers in the combination based on the order that the target numbers are picked or alternatively, in another suitable order. Each picked target number makes up a digit of the combined award. If the player picks several target numbers, the player's award is an order of the digits of the target numbers.

In a further embodiment, the gaming device provides the player with a number of picks. The gaming device also displays a masked combination of target numbers. The combination is formed by randomly selecting and placing target numbers in the combination based on the order that the target numbers are picked by the processor or in another suitable order. The combination may also be predetermined by the processor. Each picked target number makes up a digit in the combination. If the player picks all of the target numbers or digits in the combination, the gaming device preferably provides an award to the player. The award in one embodiment is based on the number of picks that the player has remaining. In one alternative embodiment, the player uses the player's remaining picks to select additional awards or prizes. In another embodiment, the player is provided with another bonus level or bonus game and the player uses their remaining picks in that bonus level or bonus game to obtain larger awards.

In another embodiment, the award provided to the player for picking all of the target symbols in a target combination is based on the number of picks that the player actually uses to obtain the combination. In this embodiment, the gaming device provides a larger award to the player for using less picks to obtain the target symbol combination.

In an alternative embodiment, the number of picks provided to the player is not displayed to the player. In this embodiment, the player's excitement and enjoyment of the gaming device increases because the player does not know when the player's picks will run out and therefore, when the game will end.

Although the present invention is discussed relative to a bonus game of a gaming machine, it should be appreciated that the present invention could be employed as a primary game in a gaming device.

It is therefore an advantage of the present invention to provide a gaming device having a related symbol selection game.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION

Gaming Device and Electronics

Figure 1A:
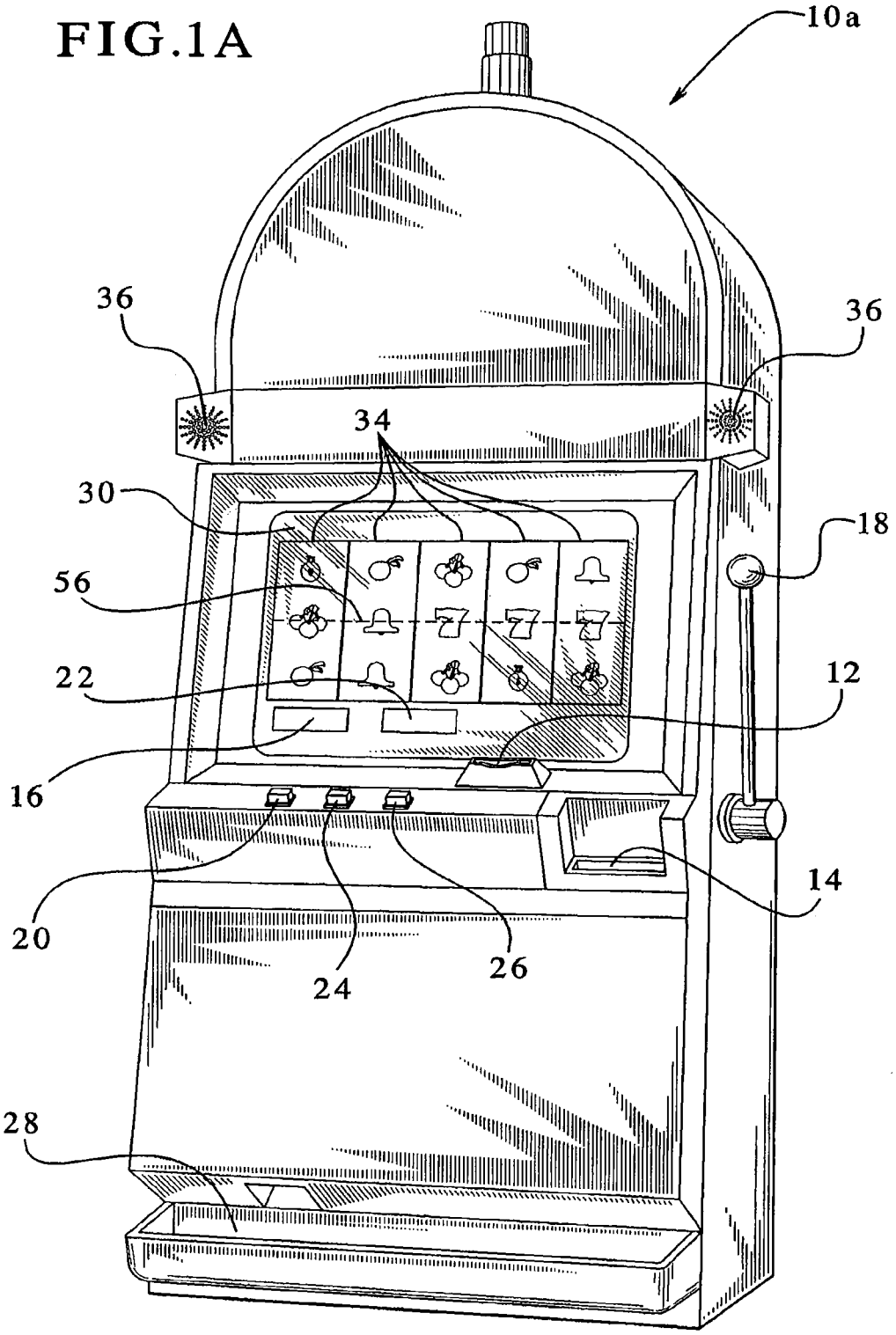
FIG. 1A is front perspective view of one embodiment of the gaming device of the present invention.
Figure 1B:
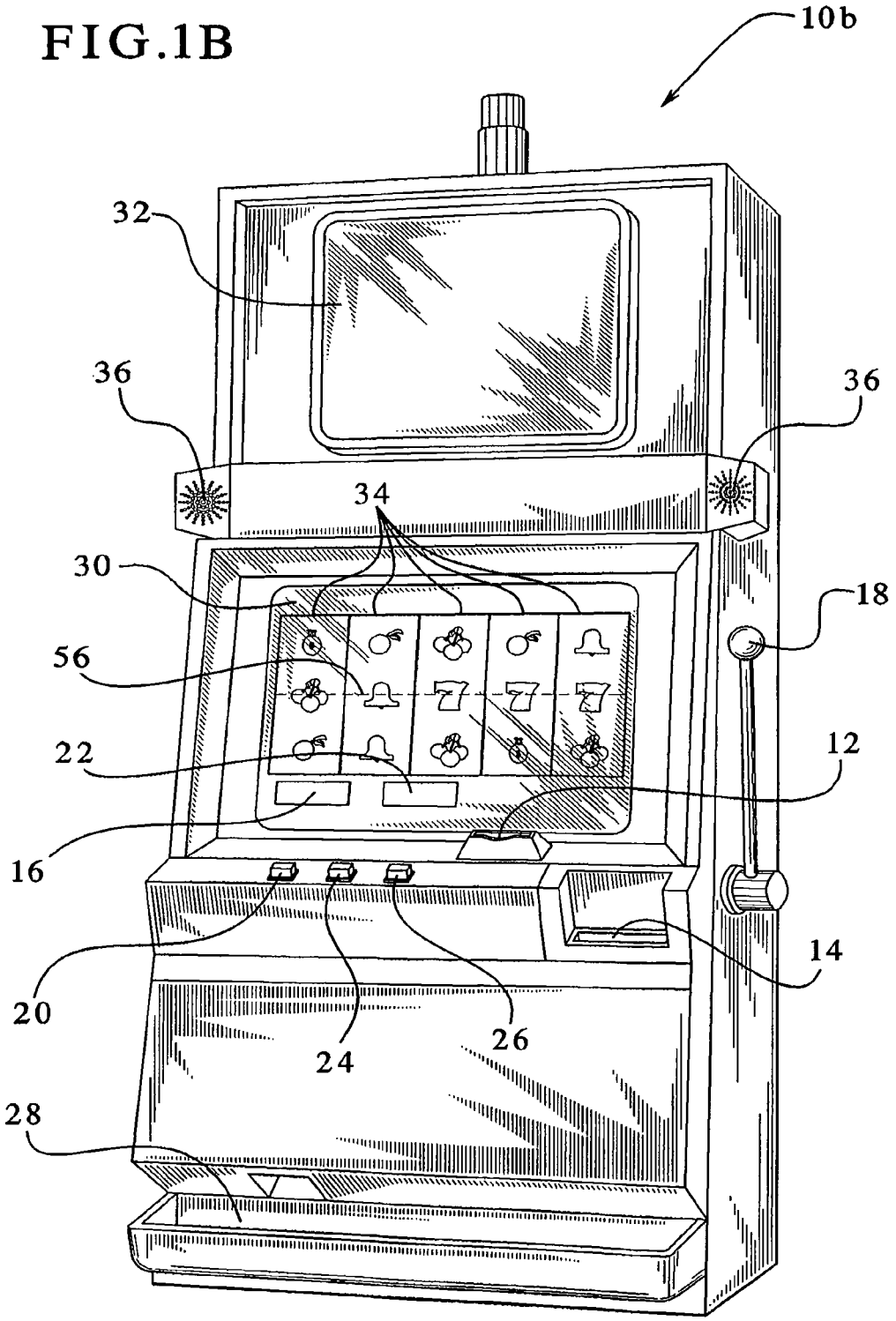
FIG. 1B is front perspective view of another embodiment of the gaming device of the present invention.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is in one embodiment a slot machine having the controls, displays and features of a conventional slot machine. It is constructed so that a player can operate it while standing or sitting, and gaming device 10 is preferably mounted on a console or cabinet. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other storage or memory device which a player can use in a desktop or laptop personal computer or other computerized platform.

Gaming device 10 can incorporate any primary game such as slot, poker, blackjack or keno, any of their bonus triggering events and any of their bonus games. The symbols and indicia used on and in gaming device 10 may be in mechanical, electrical, electronic or video form.

As illustrated in FIGS. 1A and 1B, gaming device 10 includes a coin slot 12 and bill acceptor 14 where the player inserts money, coins or tokens. The player can place coins in the coin slot 12 or paper money or ticket vouchers in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. The gaming device can also include other conventional wagering indicators such as a bet max button.

A player may "cash out" and thereby receive a number of coins corresponding to the number of remaining credits by pushing a cash out button 26. When the player "cashes out," the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30, and the alternative embodiment shown in FIG. 1B includes a central display device 30 as well as an upper display device 32. The illustrated gaming device 10 displays a plurality of reels 34 (i.e., five reels 34) in video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
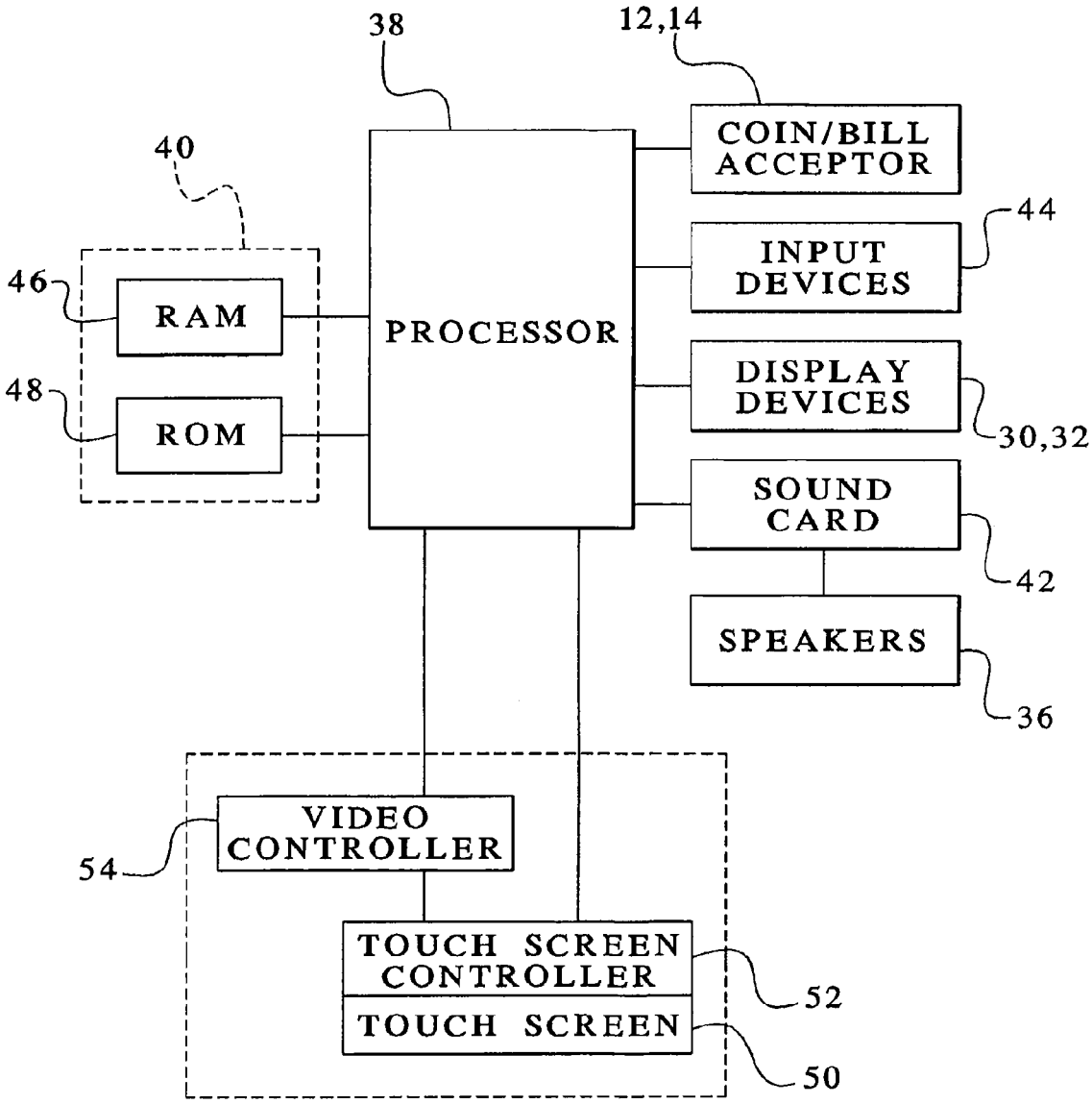
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively or individually referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the "computer" or "controller."

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. In the slot embodiment, the reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, gaming device 10 may also give players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 may use a video-based central display device 30 to enable the player to play the bonus round. The qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Bonus Game

In one embodiment of the present invention, if a player achieves a bonus triggering or qualifying condition during the primary game, the gaming device 10 automatically initiates the bonus game of the present invention.

Figure 3:
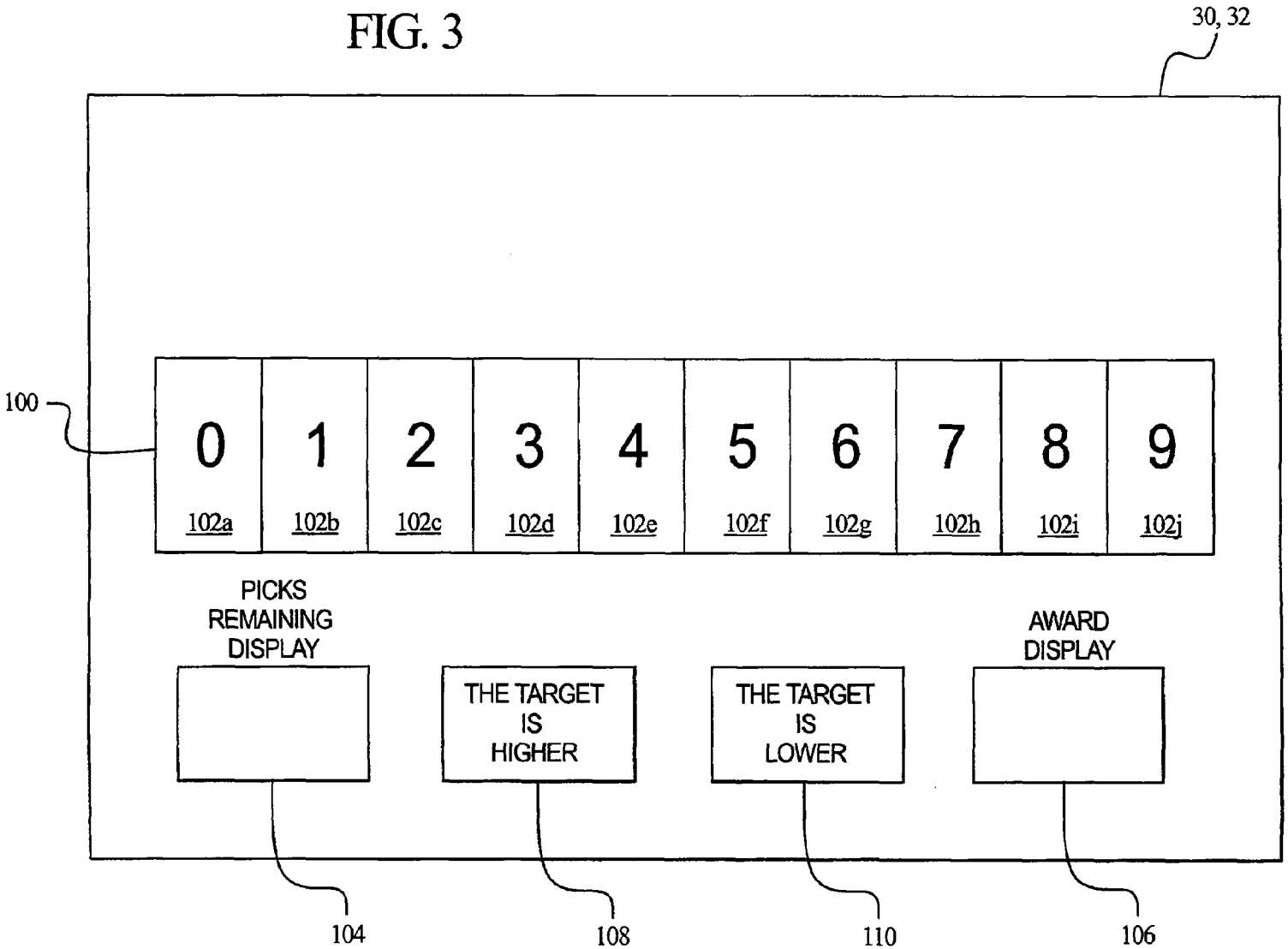
FIG. 3 is an enlarged front elevation view of one of the display devices of FIGS. 1A and 1B, which illustrates one embodiment of the present invention where the symbols in the target set are numbers.

Referring to FIG. 3, one embodiment of the display device 30 or 32 of the present invention is illustrated. The display device 30 or 32 displays a target set 100 including a plurality of player selectable symbols 102*a* to 102*j* (generally referred to as symbols 102). At least one of the symbols 102 in the target set 100 is randomly determined by the processor as the target symbol for each play of the bonus game. Although this embodiment shows one target set, it should be appreciated that in other embodiments, a bonus game may include multiple target sets. In such an embodiment, the gaming device enables a player to pick a symbol in each target set. The gaming device provides an award to the player for each picked target symbol in the target sets.

In the illustrated embodiment, the symbols are numbers and particularly integers from zero to nine. The symbols, however, may be any suitable symbols as desired. Also, the numbers are preferably displayed in sequential order starting with the lowest value on the left to the highest value on the right. It should be appreciated that any logical order may be displayed to a player based on the symbols being used in the bonus game. The order of the symbols (i.e., zero to nine) in this embodiment illustrates the relationship of the symbols to one another.

The display device includes a picks remaining display 104, an award display 106 and relationship indicators 108 and 110.

The picks remaining display 104 indicates the number of picks that are remaining in a bonus game. At the start of a game, the gaming device determines the total number of picks for that bonus game and displays the number of picks in the picks remaining display 104. The picks remaining display 104 decreases by one after each pick by a player. Thus, at any point in the game, the player knows how many picks are remaining in that game and may adjust the player's strategy accordingly. When the picks remaining display indicates that there are no picks remaining in a game, the bonus game ends.

The award display 106 indicates the total award received by a player in the bonus game. During a bonus game, any awards received by a player are added to the award indicated by the award display 106. Once a bonus game ends, the total award indicated by the award display 106 is provided to the player.

The relationship indicators 108 and 110, indicate the relationship between a picked symbol and the target symbol in the target set. In the illustrated embodiment in FIG. 3, the target set 100 includes ten symbols 102*a* to 102*j*, designated with the numbers zero through nine. Since the target set includes numbers, the relationship indicators 108 or 110 indicate whether a target number is higher or lower than a picked number in a target set. If the target number is higher than a picked number, the relationship indicator 108 is highlighted or illuminated to indicate this relationship to the player. If the target number is lower than a picked number, the relationship indicator 110 is highlighted or illuminated to indicate this relationship to the player. It should be appreciated that the relationship indicators 108 and 110 may indicate any relationship between a target symbol and a picked symbol. Although there are two relationship indicators in this illustration, a gaming device may have one or more relationship indicators as desired by the game implementor.

Figure 4:
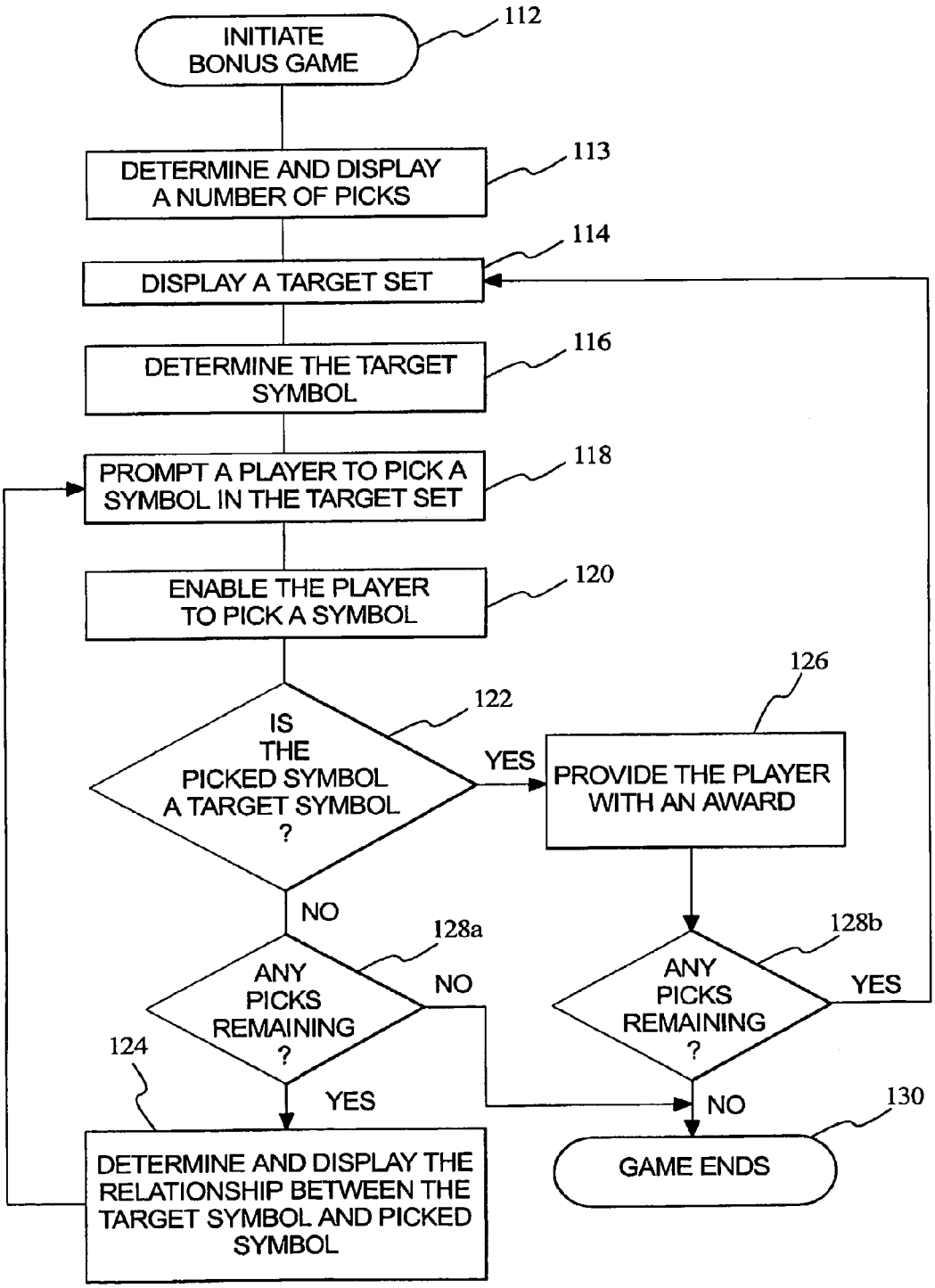
FIG. 4 is a flow diagram of one embodiment of the present invention implemented in a bonus game.

One embodiment of the bonus game of the present invention which includes multiple target sets operates according to the flow diagram in FIG. 4. The gaming device initiates a bonus game as indicated by block 112. Initially, a player receives a predetermined number of picks to start a bonus game as indicated by block 113. However, it should be appreciated that the number of picks may be randomly determined or be any number desired by the implementor. By limiting the number of picks, the chances of obtaining multiple target symbols and thereby multiple awards in this embodiment with multiple target sets becomes more difficult. Therefore, a player is challenged to obtain as many target symbols as possible before running out of picks in the bonus game. Such a challenge adds to a player's excitement and enjoyment of the game.

The gaming device then selects and displays a target set including a plurality of symbols as indicated by block 114. In one embodiment, the game displays a plurality of numbers ranging from 0 to 9. While numbers are discussed, it should be appreciated that any symbols are contemplated, including letters A to Z, signs of the Zodiac, months of the year, characters, city names, state names, etc. It is preferred that the symbols are orderly arranged such as in a sequential order in displayed the target set.

The game determines one symbol to be the target symbol in the target set as indicated by block 116. Preferably, the target symbol is randomly determined, however it should be appreciated that a target symbol may be a predetermined symbol in the target set. The target symbol is not displayed to the player until the player picks the target symbol in the target set.

Next, the gaming device prompts the player to select a symbol from the target set as indicated by block 118, which the player believes may be the target symbol in the target set. The prompt may be a statement or message displayed on the display device 30 or 32, or it may be a cursor that flashes and notifies the player to select another symbol. It should be appreciated that the prompt may be any type of prompt initiated by the gaming device 10.

Once the player picks a symbol, the gaming device 10 completes a series of decisions as illustrated by the decision diamonds in the flow diagram of FIG. 4. The processor of the gaming device 10 first determines if the picked symbol is a target symbol as indicated by decision diamond 122. The processor of the gaming device compares the picked symbol to the predetermined target symbol in the target set.

If the picked symbol is the target symbol, the gaming device highlights the target symbol in some manner to notify the player that the player picked the target symbol in the target set. It should be appreciated that the target symbol may be highlighted by illuminating it, changing the color of the target symbol or by any other desired method. The gaming device then provides the player with an award as indicated by block 126. In the embodiment where there is only one target set in the game, the bonus game ends. In the embodiment where there are several target sets in a bonus game, the processor of the gaming device 10 must determine if the player has any picks remaining in the bonus game as indicated by decision diamond 128*b*. If there are no picks remaining in the game, the game ends as indicated by oval 130. The player receives the total award for that bonus game.

The player receives an award for each picked target symbol. In one embodiment with multiple target sets, the gaming device provides the player with an award associated with a target symbol. However, it is contemplated that the award value may also be randomly generated by the processor 38. In one embodiment of the present invention, the awards associated with the target symbols are associated with probabilities such that one award has a greater probability of being associated with a target set or symbol than another award.

In another embodiment, the gaming device provides an award to a player based on the order in which the target symbols are picked. In this embodiment, target symbols are preferably numbers and the player's award is the value of the target number itself. When a player picks a target number, the target number is separately displayed on the display device. Any subsequently picked target numbers are displayed in sequential order next to the previously picked target number or numbers. The player receives the total award designated by the combination of the individual awards from each target symbol. For example, a target set includes the numbers one through nine. A player picks a target number one from a first target set. Then the player picks target number zero from a second target set and target number nine from a third target set. The player's total award for that bonus game is one hundred nine based on the sequential order of the picked target symbols. It should be appreciated that a player may receive the sum of the individual awards or some other suitable award as desired by the game implementor.

If the player has picks remaining in the bonus game, the gaming device 10 displays a new target set with a plurality of symbols to the player as indicated by block 114. The gaming device determines the target symbol and prompts the player to pick a symbol from the target set as indicated by blocks 116 and 118 respectively. The gaming device then repeats the steps described above starting at block 120.

If the player picks a symbol that is not the target symbol, the gaming device 10 must determine whether the player has any picks remaining in the bonus game as indicated by decision diamond 128*a*. If the player has picks remaining, the gaming device determines the relationship between the picked symbol and the target symbol. Once the relationship is determined, the gaming device displays the relationship to the player as indicated by block 124. The gaming device prompts the player to pick another symbol as indicated by block 118. The process described above is repeated until the player picks a target symbol in the target set or the player runs out of picks. If, however, the player does not have any picks remaining in block 128A, the game ends as indicated by block 130 and the bonus game award total is transferred to the player.

FIGS. 5A to 5K illustrate an example of one embodiment of the present invention. In this example, the target set symbols are numbers and the player starts out the game with seven picks. Also, the player does not start out with any symbols being revealed or with any type of award as shown by display 106.

Figure 5A:
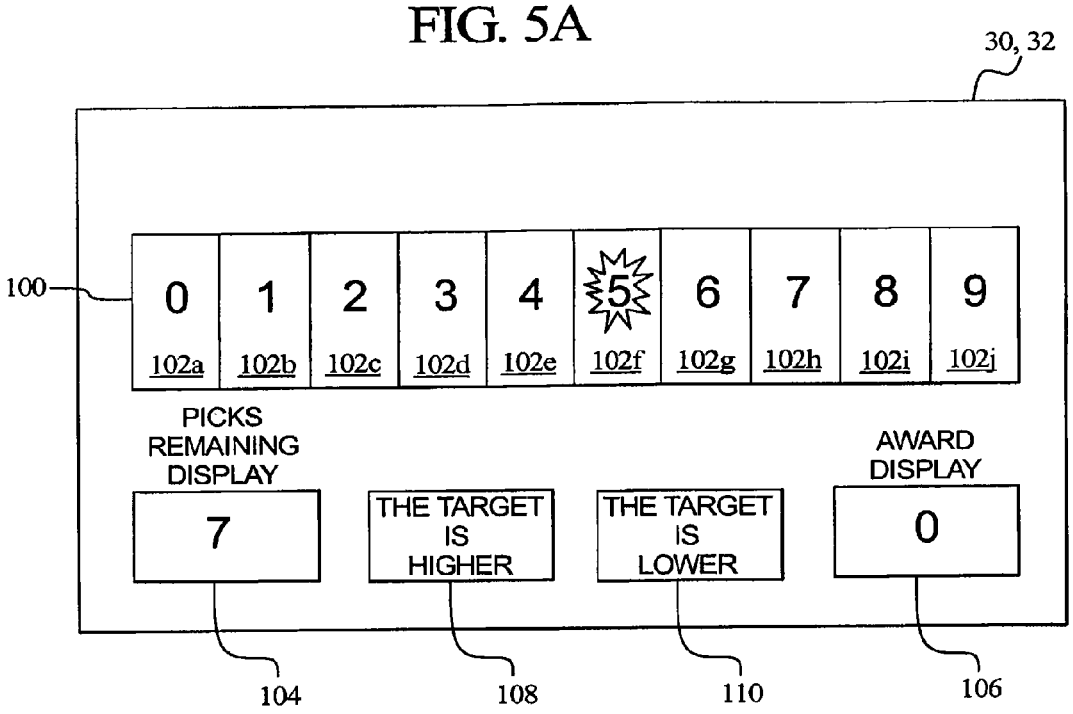
FIGS. 5A and 5B are enlarged front elevation views of one of the display devices of FIGS. 1A and 1B illustrating a first pick by a player in a target set and the response by the gaming device.

Referring to FIG. 5A, a display device 30 or 32 including a first target set 100 with a plurality of target symbols or numbers 102*a* through 102*j* is illustrated. This embodiment includes a plurality of target sets. The gaming device randomly determines one of the numbers zero through nine to be the target symbol or target number in the first target set. The gaming device selects nine as the target number. The target number is not identified to the player until the player picks the target number in the target set. The gaming device then prompts the player to pick a number from the target set in a suitable manner (not shown) such as using a touch screen or other symbol or number selector connected to the processor. In this game, the player's first pick is the number five designated as 102*f* from the target set 100.

Figure 5B:
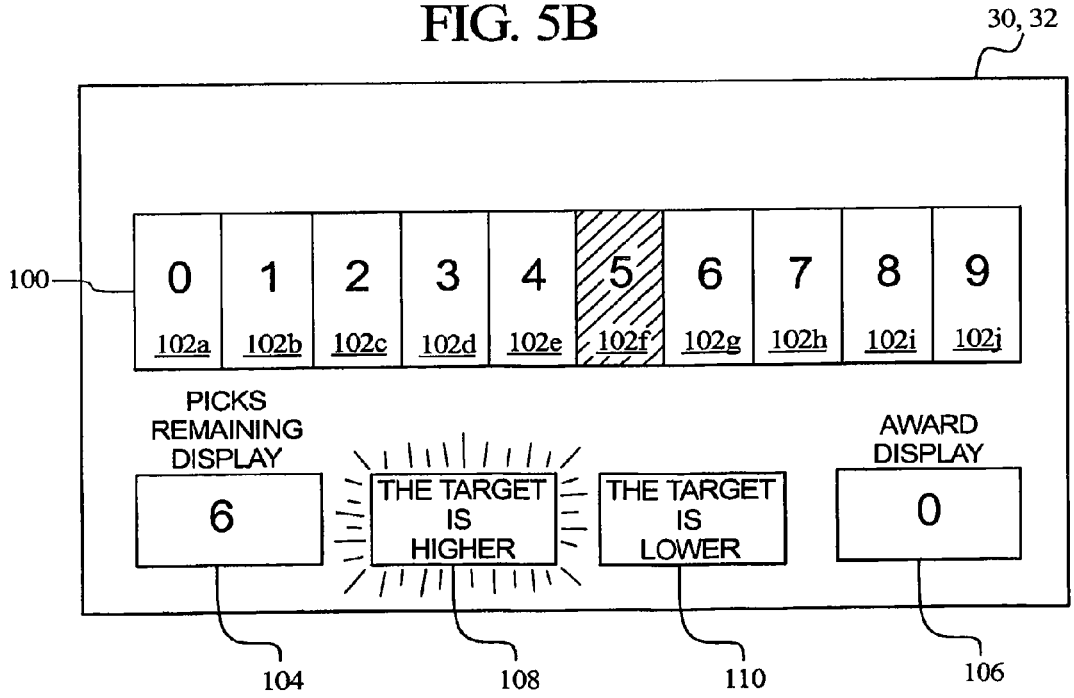

Referring now to FIG. 5B, the number five is highlighted as being the player's first pick. The processor of the gaming device 10 now determines whether the player's first pick is the target number which is nine, or whether the target number is higher or lower than the picked number. In this example, the gaming device compares the first pick 102*f* to the target number nine. The gaming device 10 determines that the target number is higher than the picked number, five, and therefore highlights the relationship indicator 108. Relationship indicator 108 illuminates to notify the player that the target symbol is higher than the first picked number. The player must pick a symbol that is higher than their first pick so that they have a chance to obtain the target symbol. Also, the pick remaining display 104 now shows that there are six picks remaining in the bonus game.

Figure 5C:
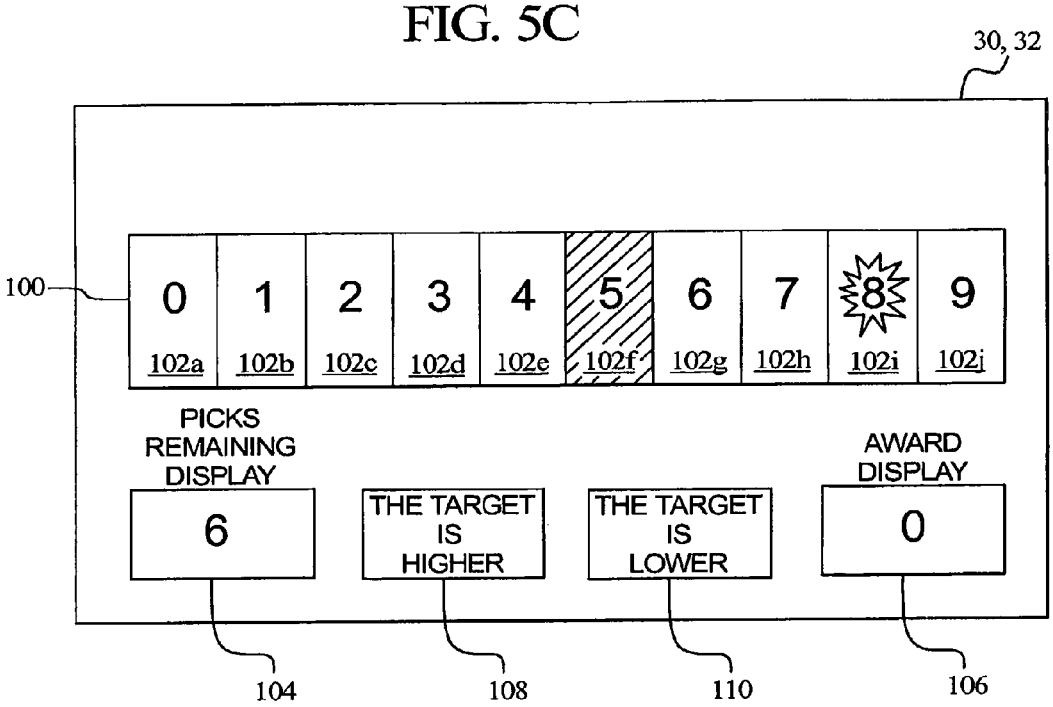
FIGS. 5C and 5D are enlarged front elevation views of one of the display devices of FIGS. 1A and 1B illustrating a second pick by a player in the target set and the response by the gaming device.
Figure 5D:
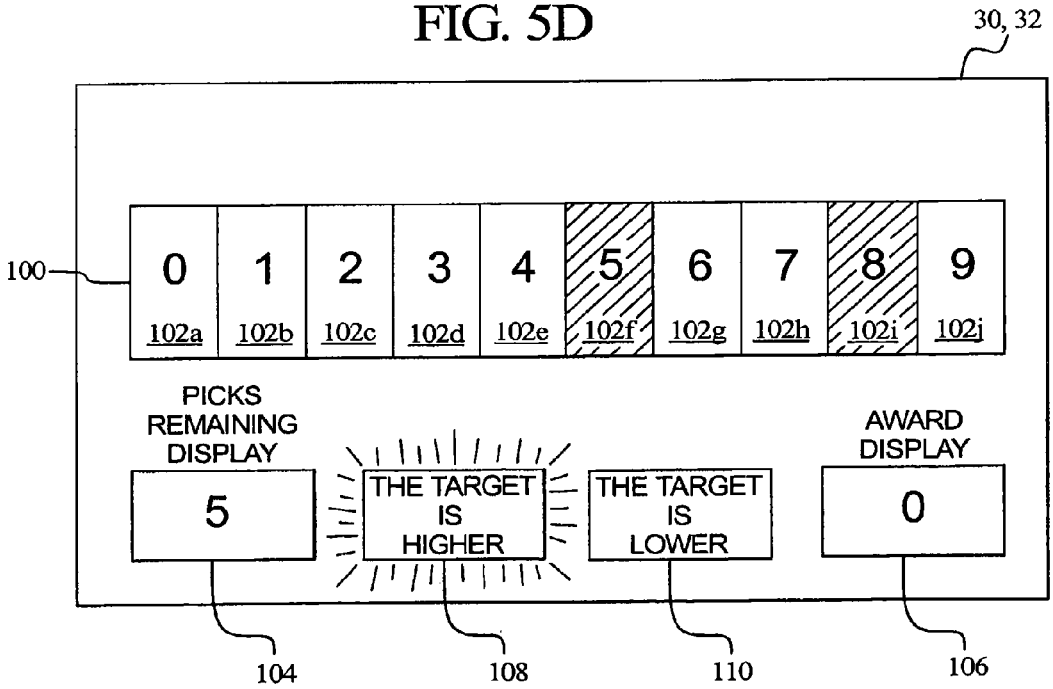

The player makes their second pick from the group of numbers 102 in target set 100 as illustrated in FIG. 5C. The player picks the number eight, designated as 102*i*, which is highlighted. The processor of the gaming device determines that the target number nine is still higher than the second pick and therefore highlights the relationship indicator 108 as illuminated in FIG. 5D. Relationship indicator 108 illuminates to notify the player that the target number is higher than the picked number. Because there is only one number higher than the player's last pick, the player will likely obtain the target symbol on their next pick. It should be appreciated that although the next pick appears obvious, the player preferably must make the correct pick of the target number. If by chance, the player picks a different number, the game will continue as described above. In one embodiment of the bonus game, the player will automatically obtain the target number when there is only one possible pick remaining in the target set. In another embodiment, the processor deactivates numbers that were selected by the player and were not the target numbers. In this embodiment, the player eventually obtains the target number when all of the other numbers in the target set, except the target number, are deactivated by the processor. Referring to FIG. 5D, the player has five picks remaining in the bonus game as indicated by the pick remaining display 104.

Figure 5E:
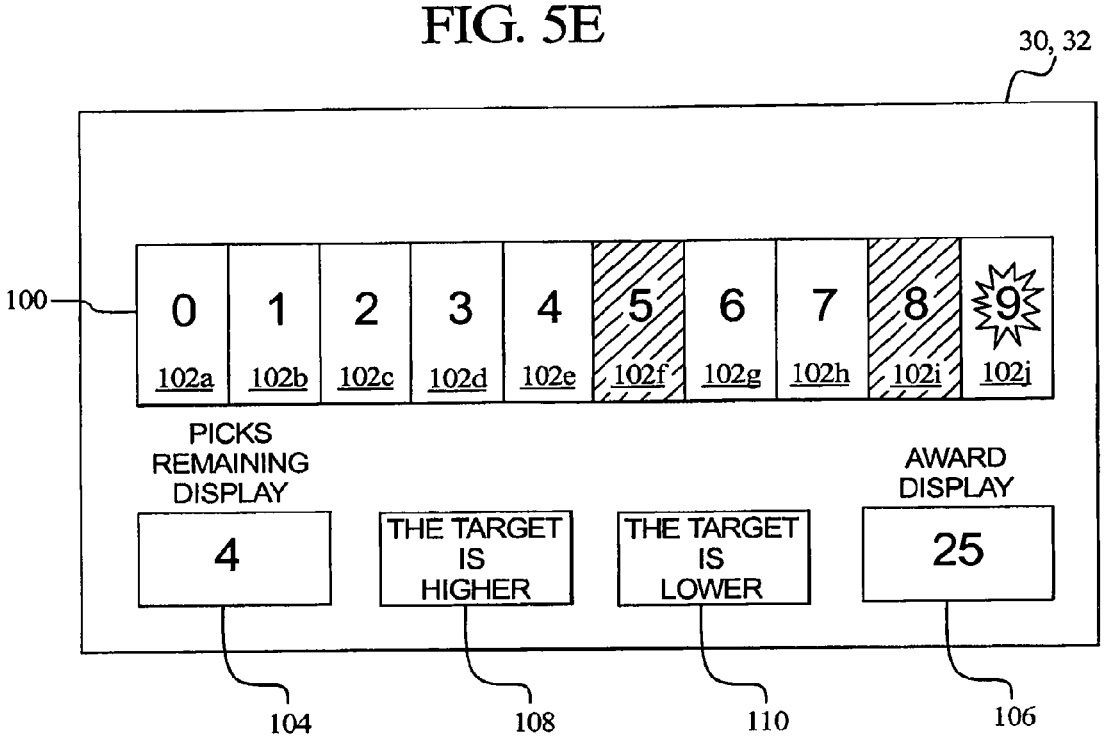
FIG. 5E is an enlarged front elevation view of one of the display devices of FIGS. 1A and 1B illustrating a third pick by a player in the target set, which is the target symbol, and an award associated with the target symbol.

Referring now to FIG. 5E, the player picks the first target number. The player picked the number nine which is the target number in the target set 100. Thus, an award, which in this embodiment is a predetermined award value of twenty-five, is displayed in the award display 106. The player still has four picks remaining in the bonus game as indicated in the pick remaining display 104 and therefore continues to play the bonus game. It should thus be appreciated that in this embodiment, the number of picks the player uses for each target set will determine the number of picks available to the player for subsequent target sets.

Figure 5F:
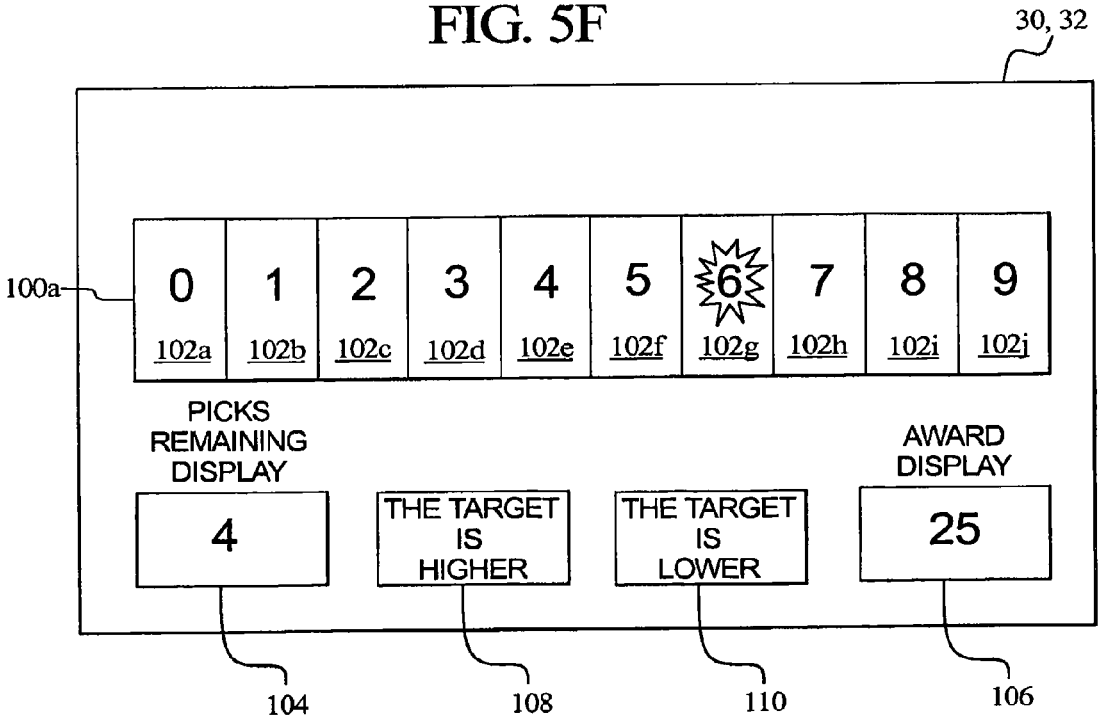
FIGS. 5F and 5G are enlarged front elevation views of one of the display devices of FIGS. 1A and 1B illustrating a first pick by the player in a new target set, which is the fourth overall pick in the bonus game, and the response by the gaming device.

In FIG. 5F, the player is now trying to match a second target number in a new target set 100*a*. The gaming device determines the target number to be the number four (102*d*) from the second target set. As illustrated, the picked numbers that were highlighted previously, are not highlighted anymore because the player is attempting to obtain a new target number in a new target set 100.

Figure 5G:
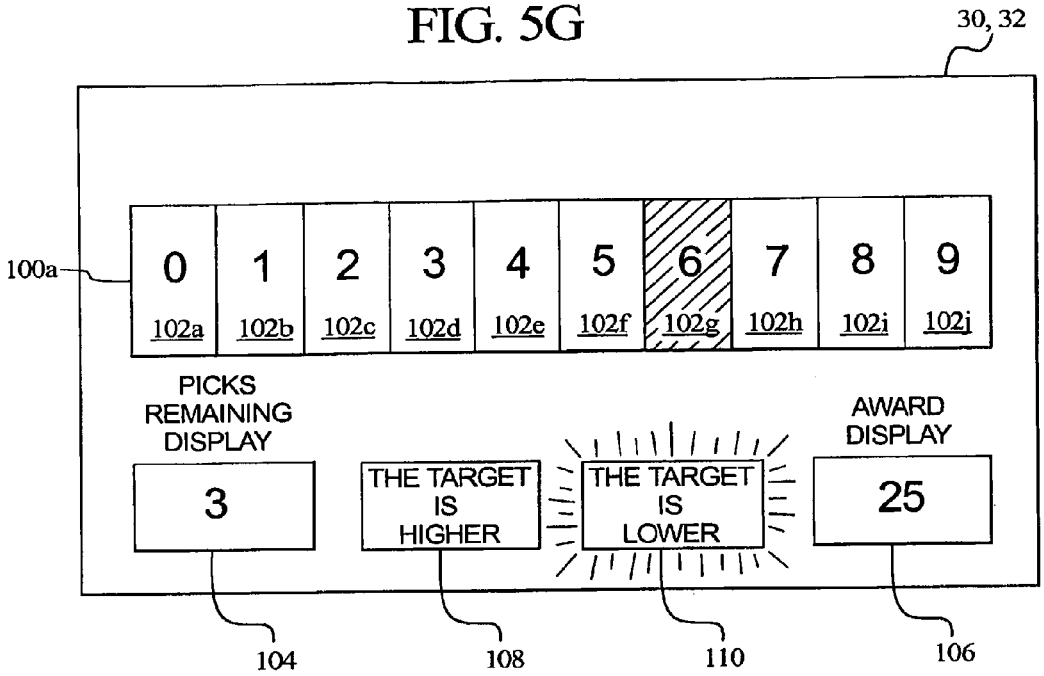

Here, the player picks the number six designated as 102*g*, from the group of numbers 102 in the second target set 100 as illustrated in FIG. 5F. The processor of the gaming device 10 determines whether this pick is the target number or if the target number is higher or lower than the picked number. In this case, as shown in FIG. 5G, the target number four is lower than the picked number. Thus, the target number indicator 110 is illuminated, which notifies the player that the target number is lower than the picked number. On the next pick, the player must pick a lower number than their first pick in this target set to obtain the target number. After this pick, the player has only three picks remaining as indicated by the pick remaining display 104.

Figure 5H:
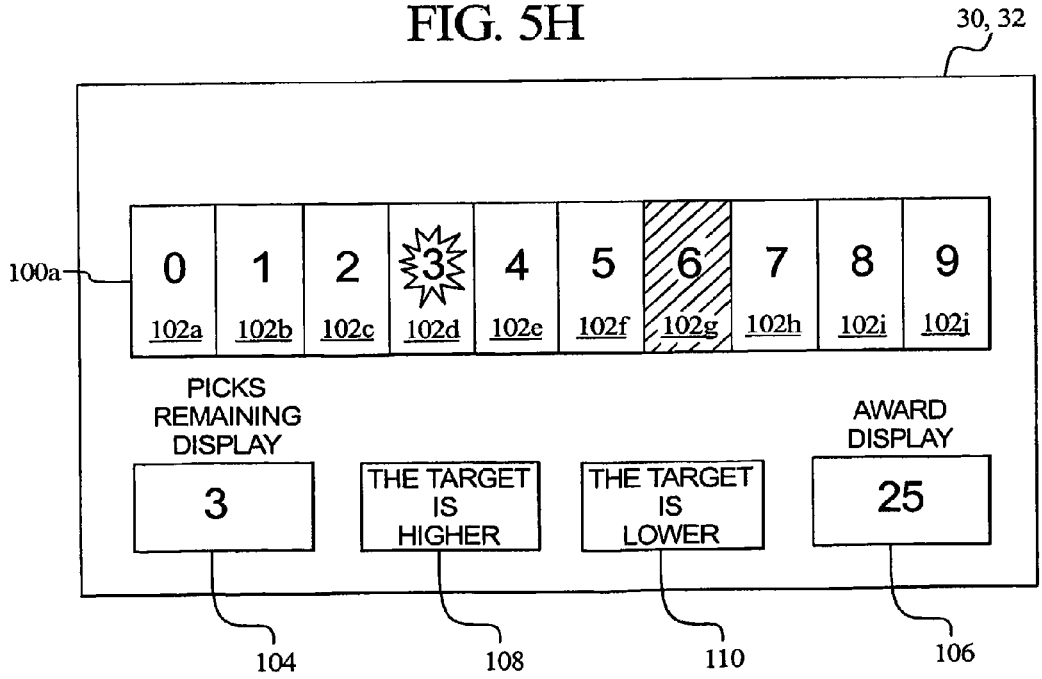
FIGS. 5H and 5I are enlarged front elevation views of one of the display devices of FIGS. 1A and 1B illustrating a second pick by the player in the target set, which is the fifth overall pick in the bonus game, and the response by the gaming device.
Figure 5I:
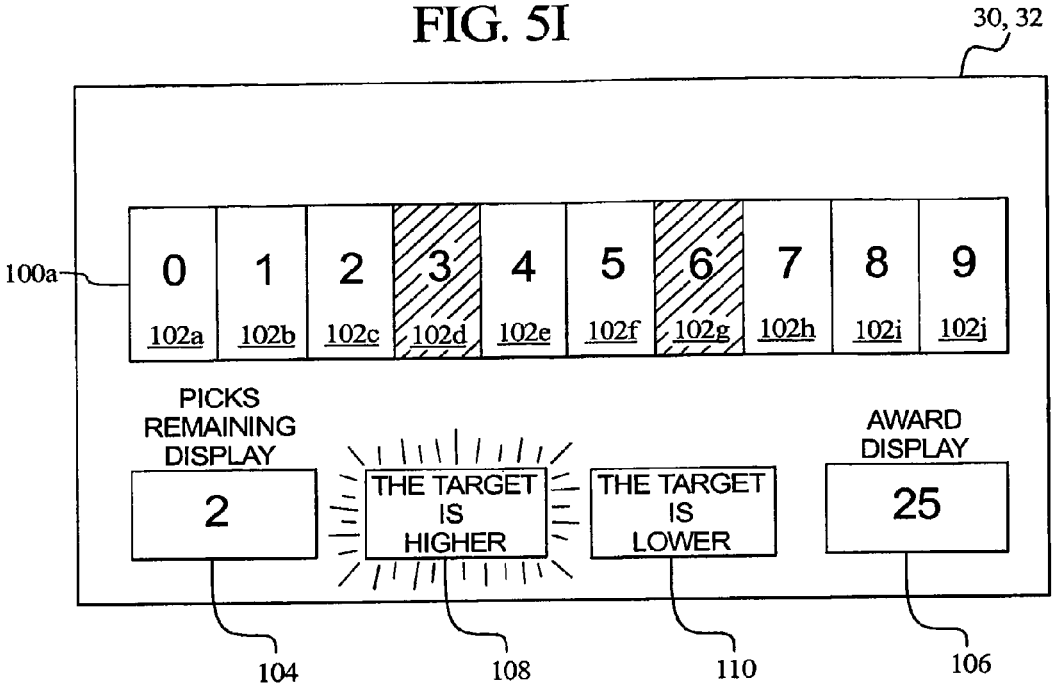

In FIG. 5H, the player makes their second pick in the target set and the sixth pick overall in the bonus game. The player picks the number three designated as 102*d*. This pick is lower than their previous pick of six that is highlighted. However, as FIG. 5I illustrates, this pick is still not the target number. The processor of the gaming device 10 determines that the target number four is higher than the player's second pick, three, and notifies the player by illuminating the target symbol indicator 108. The player now must pick either the four (102*e*) or five (102*f*) with their next pick. The player has only two picks remaining as shown in the pick display 104.

Figure 5J:
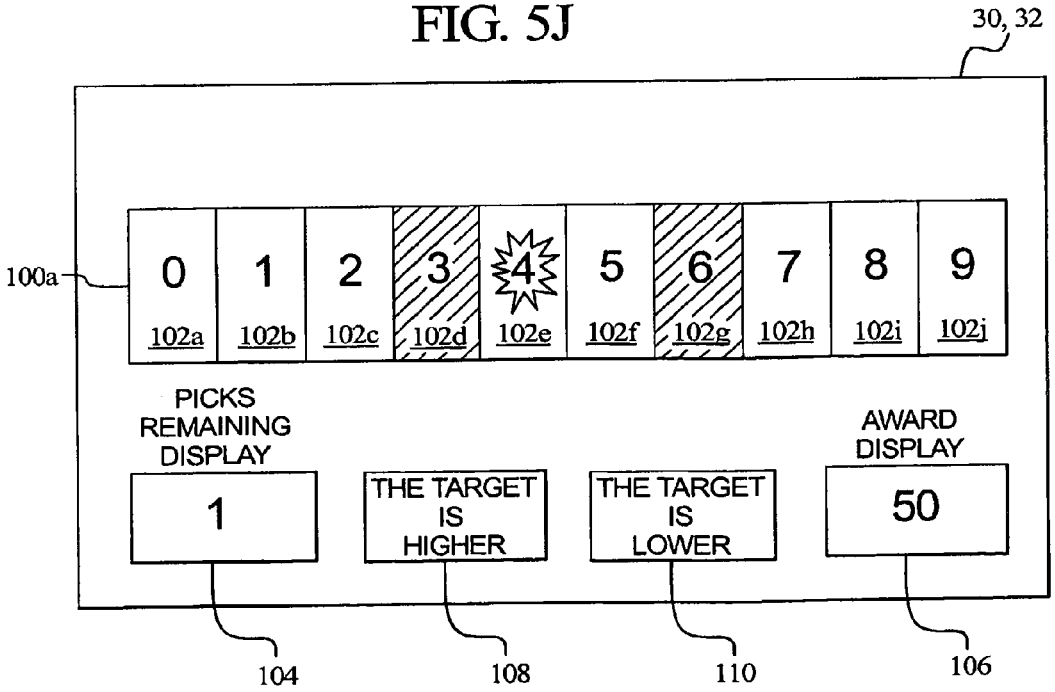
FIG. 5J is an enlarged front elevation view of one of the display devices of FIGS. 1A and 1B illustrating a third pick by the player in the target set, which is the sixth overall pick in the bonus game, that results in a second target symbol and an award.

Referring now to FIG. 5J, the player picks the target number from the second target set 100*a*. The player picked the number four (102*e*), which is the target number. The gaming device provides an award of twenty-five to the player. The award of twenty-five is added to the player's previous award of twenty-five to give a total award for the bonus game of fifty. The pick remaining display 104 now shows that the player has only one pick remaining in this game to obtain another target number.

Figure 5K:
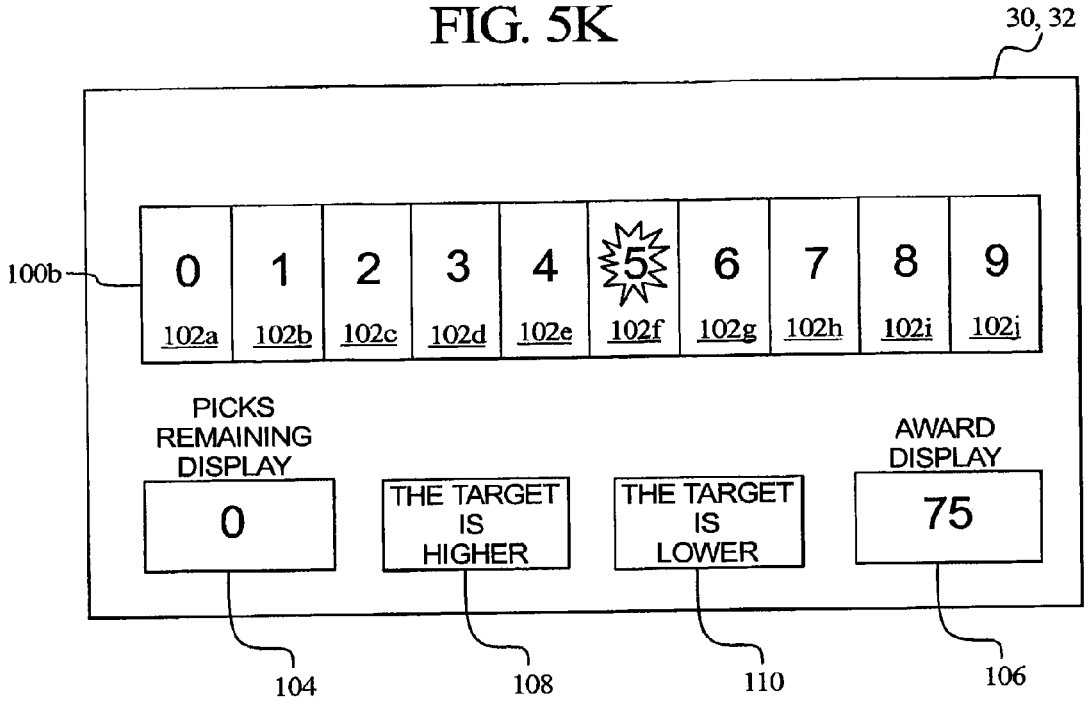
FIG. 5K is an enlarged front elevation view of one of the display devices of FIGS. 1A and 1B illustrating a first pick in a new target set, which is the seventh overall and final selection in the bonus game, that results in a third target symbol and an award.

In FIG. 5K, the player makes a first pick in the third target set 100*b*. The gaming device determines the target number to be the number five (102*f*). Although this is the player's first pick in the new target set, it is the player's seventh and final pick in the bonus game. The player picks the number five (102*f*) from the third target set. Fortunately for the player, the player picked the target number in the third target set on their first pick. The gaming device provides an award of twenty-five to the player for picking the target number. The player now has a total award of seventy-five for the bonus game. Since this is the final pick, the player receives a total award of seventy-five for the bonus game as indicated by the award display 106. If the player did not pick the target number with the player's final pick, the player may not obtain an award for the third target set 100*b*. It should be appreciated that the award associated with each subsequent target set or target number increases in one embodiment.

Figure 6:
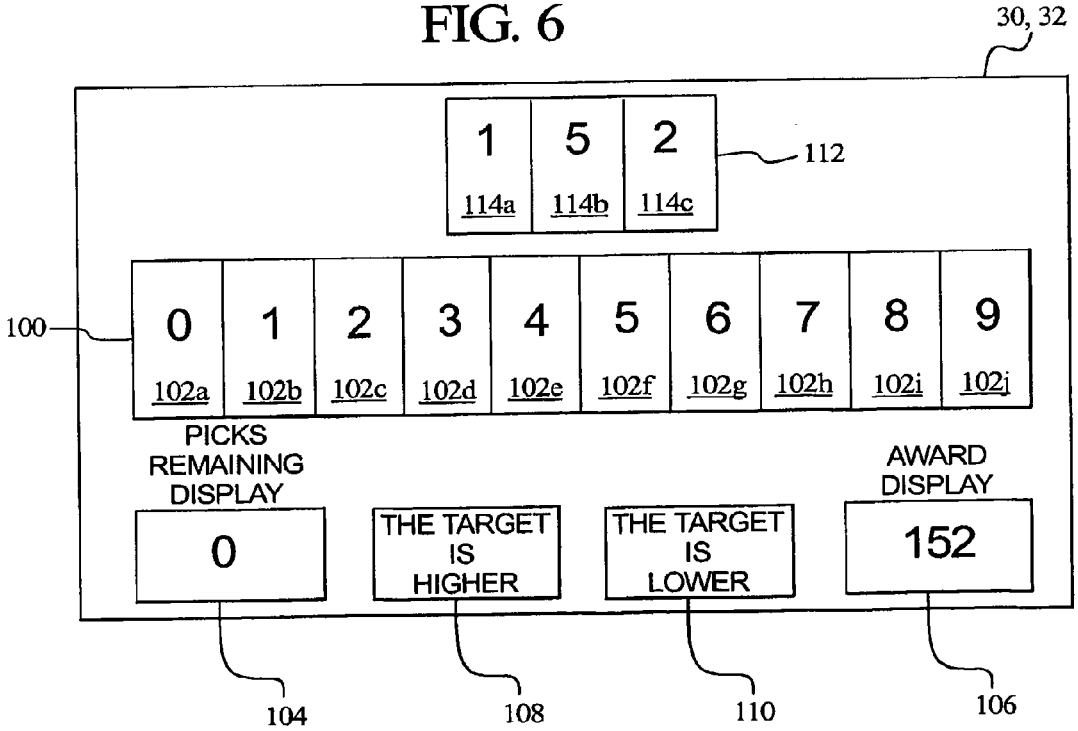
FIG. 6 is an enlarged front elevation view of one of the display devices of FIGS. 1A and 1B illustrating another embodiment of the present invention where the bonus game award equals the value of a target symbol combination.

Referring now to FIG. 6, another embodiment of the present invention is illustrated where the award or combined award equals a combination of target symbols. The symbols in this embodiment are preferably numbers. However, it should be appreciated that the symbols can be any suitable symbols desired by the game implementor. In this embodiment, the gaming device provides an award for the combination of each picked target number. The award or combined award is the order of the target numbers. Once the target number is picked, the target number is transferred to the award combination 112. The award combination preferably includes three award locations 114 including a first award location 114*a*, a second award location 114*b* and a third award location 114*c*. It should be appreciated that an award combination can include any suitable number of award locations as desired.

In this illustration, the player picked the first target number, which was the number one (102*b*). The number one, therefore, is transferred to the first award location 114*a*. The player then picked the target number five (102*f*) from the second target set. This target number is placed in the second award location 114*b* in the award combination 112. If the player ran out of picks at this point in the bonus game, the player would receive the award indicated by the award combination. The award would be the value represented by the first and second target numbers in award locations 114*a* and 114*b*, which is fifteen. This is a relatively low bonus award because the first number is a low number. Because of such possibility, the game implementor may want to weight higher numbers in the target set to be randomly selected for the first target set to increase the award to the player in such cases. Alternatively, if the award is below a pre-determined threshold, the processor may cause a replay of the game to provide a sufficient award to the player. Alternatively, the number may be used as a non-credit value such as a multiplier, number of free spins or number of free games.

In the third target set, the player picked the third target number, which was two. The target number two is transferred to the third and final award location 114*c* in the award combination 112. In this embodiment, the bonus game ends when the player completes the award combination or runs out of picks. Here, the player completed the award combination 112. The player receives the total award indicated by the award combination 112, which is one hundred fifty-two. This award is displayed in the award display 108.

In one aspect of this embodiment, the player may receive an additional award (not shown) for completing the award combination 112. The additional award may be a predetermined award, a random award or any type of award desired. In another aspect of this embodiment, each subsequent target set is larger in size, or includes more symbols or numbers. By increasing the target set size, the level of difficulty of obtaining the target numbers in each subsequent target set increases. For example, in a game with three target sets, the first target set includes five numbers, the second target set includes seven numbers and the third target set includes ten numbers. It should also be appreciated that the target set size could decrease or could be randomly determined.

In another embodiment of the present invention, the gaming device provides additional awards to a player for having picks remaining at the end of a bonus game. Preferably, the gaming device provides an award for each remaining pick. In another aspect of this embodiment, the player uses their remaining picks to select additional awards or prizes. In another embodiment, the player is provided with another bonus level or bonus game for having picks remaining in the game. The player uses their remaining picks in that bonus level or bonus game to obtain larger awards. In a further aspect of this embodiment, the gaming device displays several masked or hidden selections to the player (not shown). The player picks a selection with each remaining pick from the bonus game. Each selection provides an additional award to the player. The additional award may be any type of award desired by the game implementor.

Figure 7:
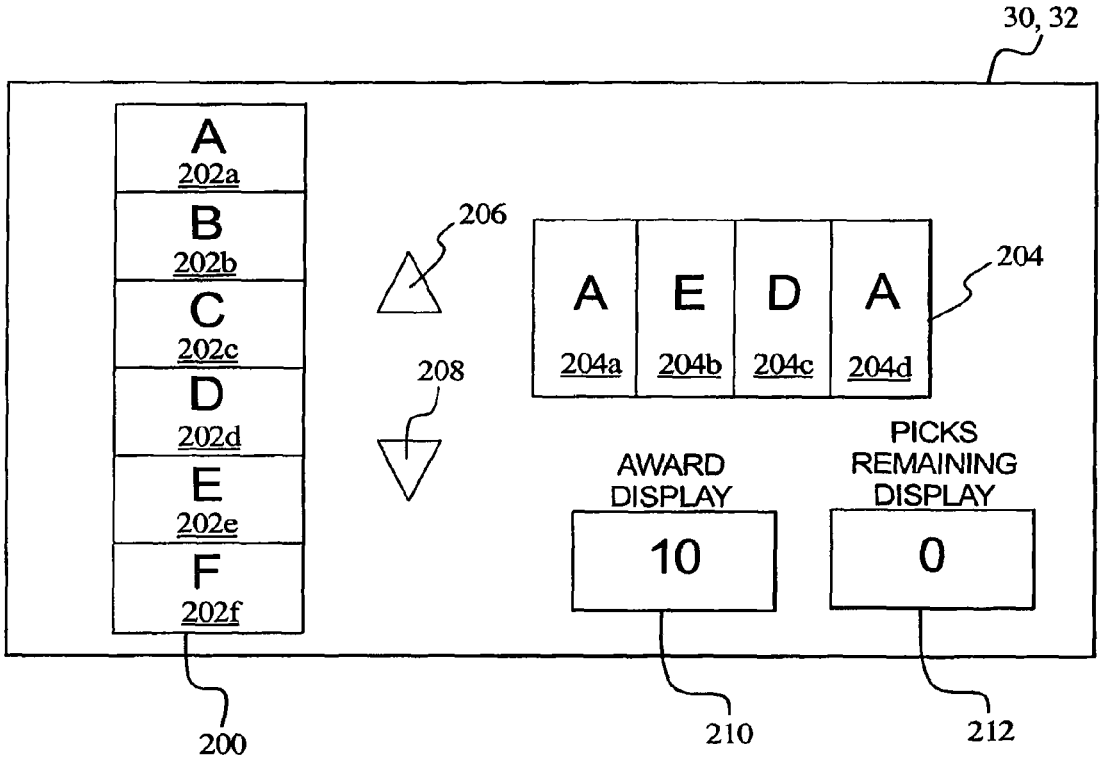
FIG. 7 is an enlarged front elevation view of one of the display devices of FIGS. 1A and 1B illustrating another embodiment of the present invention.

Referring now to FIG. 7, the display device 30 or 32 illustrates another embodiment of the present invention. In this embodiment, the target set 200 includes symbols 202 designated as 202*a* to 202*f*. The symbols 202 are letters in the alphabet and are arranged in a vertical configuration. The gaming device provides a predetermined award associated with each target letter. The award can also be based on the total number of target letters obtained by a player in the bonus game. The relationship indicators are represented by an up arrow 206 and a down arrow 208. Relationship indicator 206 is highlighted or illuminated if a target letter is higher than or above a picked symbol. If the target letter is lower than or below a picked symbol then the down arrow 208 is highlighted. If a player obtains a target letter in the target set 100, the target letter is transferred to the award combination 204. The award combination includes one or more award locations. In this illustration, the award combination has four award locations 204*a* to 204*d*. The first award location 204*a* represents the first target letter obtained by the player, the second award location 204*b* represents the second target letter obtained by the player, and so forth. In this illustration, the player obtained all four of the target letters in the award combination 204. Each target letter represents an award determined by the game implementor. This embodiment also has an award display 210 that indicates the accumulated award provided to the player during the bonus game. It also includes a pick remaining display 212 that indicates the number of picks remaining in the bonus game.

Figure 8:
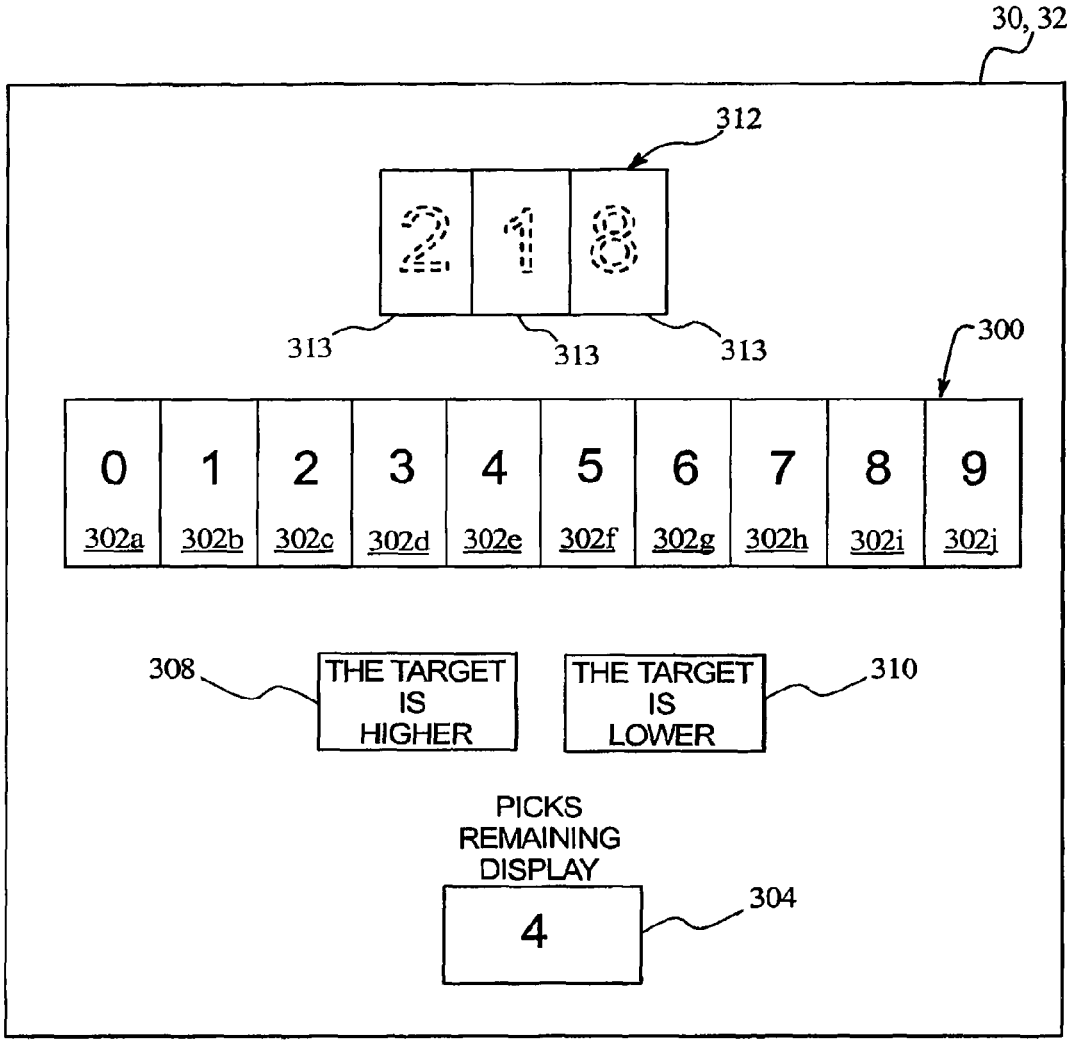
FIG. 8 is an enlarged front elevation view of the display devices of FIGS. 1A and 1B illustrating a further embodiment of the present invention wherein the bonus game includes a target symbol combination.

Referring now to FIG. 8, a further embodiment of the present invention is illustrated where the gaming device provides the player with a number of picks at the beginning of the bonus game. The number of picks such as four is displayed to the player by the picks remaining display 304. The gaming device also displays a masked target combination 312 having one or more masked target numbers 313. The player picks a number 302*a* to 302*j* from the target set 300 until the player picks a target number. The target number indicators 308 and 310 indicate whether the selected number is higher or lower than the target number.

In FIG. 8, the target combination includes three masked target numbers "2," "1" and "8" (shown in phantom). The processor forms the target combination 312 by randomly selecting and placing the target numbers 313 in the target combination from a plurality of target numbers (not shown) based on the order that the target numbers are selected. It should be appreciated that the target combination may include target symbols or other characters as desired by the game implementor. It should also be appreciated that the order that the target numbers are placed in the target combination can be any suitable order. Additionally, the target combination may be predetermined by the processor. Each picked target number in a target set is a digit in the target combination.

If the player picks all of the target numbers or digits in the combination, the gaming device preferably provides an award (not shown) to the player. The award is preferably based on the number of picks that the player has remaining in the bonus game. In one embodiment, the player uses their remaining picks to select additional awards or prizes. In another embodiment, the player is provided with another bonus level or bonus game and the player uses their remaining picks in that bonus level or bonus game to obtain additional awards.

In another embodiment, the award provided to the player for picking all of the target numbers or symbols in the target combination is based on the number of picks that the player actually uses to obtain the target combination. In this embodiment, the gaming device provides a larger award to the player for using less picks to obtain the target combination. It should also be appreciated that the player may also obtain an additional award or larger award for obtaining the target number or symbol in a target set based on the number of picks used by the player.

In an alternative embodiment, the number of picks provided to the player is not displayed to the player. In this embodiment, the player's excitement and enjoyment of the bonus game increases because the player does not know when their picks will run out and therefore, when the game will end.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is claimed as follows:

1. A method of operating a gaming system, said method comprising:

causing at least one processor to execute a plurality of instructions stored in at least one memory device to operate with at least one display device and at least one input device to:

(a) display a plurality of different target sets, each of said target sets including a different plurality of selectable symbols;

(b) designate one of said selectable symbols in each target set as a target symbol for that target set;

(c) for each of the target sets, enable a player to pick any one of said selectable symbols from said target set;

(d) for each of the target sets, after receiving a pick of any one of said selectable symbols of said target set from the player, if the picked selectable symbol is not the target symbol of said target set and if said pick is not a last pick, indicate a relationship between said target symbol of said target set and the picked selectable symbol, wherein the indicated relationship includes a subset of the selectable symbols in said target set which includes said target symbol for that target set and which enables said target symbol for said target set to be picked with a next pick; and (e) if any picked selectable symbols are the target symbols of their respective sets, display and provide a combined award based on an order in which said picked target symbols are picked.

2. The method of claim 1, which includes causing the at least one processor to execute the plurality of instructions to determine the combined award based on a total number of picked target symbols.

3. The method of claim 1, which includes causing the at least one processor to execute the plurality of instructions to operate with the at least one display device to display and provide an additional award if all of said target symbols of the target sets are picked.

4. The method of claim 1, which includes causing the at least one processor to execute the plurality of instructions to operate with the at least one display device and the at least one input device to enable the player to make a number of picks of said selectable symbols of the target sets, wherein said selectable symbols are picked until all of the target symbols of said target sets are picked or until there are no picks remaining from the number of picks.

5. The method of claim 1, which is provided through a data network.

6. The method of claim 5, wherein the data network is an internet.

7. A method of operating a gaming system, said method comprising:

causing at least one processor to execute a plurality of instructions stored in at least one memory device to operate with at least one display device and at least one input device to:

(a) display a plurality of different target sets, each of said target sets including a different plurality of selectable symbols;

(b) designate one of said selectable symbols in each target set as a target symbol for that target set;

(c) enable a player to make a number of picks of said selectable symbols of said target sets, wherein said selectable symbols are picked until all of said target symbols of said target sets are picked or until there are no picks remaining;

(d) for each of the target sets, after receiving a pick of one of said selectable symbols of said target set from the player, if the picked selectable symbol is not the target symbol of said target set and if said pick is not a last pick, indicate a relationship between said target symbol of said target set and the picked selectable symbol, wherein the indicated relationship includes a subset of selectable symbols of said target set, which includes said target symbol for that target set and which enables said target symbol for said target set to be picked with a next pick; and (e) if any picked selectable symbols are the target symbols of their respective sets, display and provide a combined award based on an order in which said picked target symbols are picked.

8. The method of claim 7, which includes causing the at least one processor to execute the plurality of instructions to determine the combined award based on a total number of picked target symbols.

9. The method of claim 7, which includes causing the at least one processor to execute the plurality of instructions to operate with the at least one display device to display and provide an additional award if all of said target symbols of the target sets are picked.

10. The method of claim 7, which is provided through a data network.

11. The method of claim 10, wherein the data network is an internet.

12. A method of operating a gaming system, said method comprising:

causing at least one processor to execute a plurality of instructions stored in at least one memory device to operate with at least one display device and at least one input device to:

(a) display a plurality of target sets, each target set including a plurality of selectable symbols;

(b) for each target set, designate one of said selectable symbols of said target set as a target symbol;

(c) enable a player to pick any one of said selectable symbols from one of said target sets; and (d) for each of the target sets, after receiving a pick of any one of said selectable symbols which is not said target symbol of said target set and if said pick is not a last pick, indicate a relationship between said target symbol of said target set and the picked selectable symbol, wherein the indicated relationship includes a subset of the selectable symbols of the target set which includes said target symbol of said target set and which enables said target symbol of said target set to be picked with a next pick; and (e) if a plurality of said target symbols are picked, display and provide an award, wherein said award is based on an order in which said plurality of picked target symbols are picked and a number of picks used to pick said plurality of picked target symbols.

13. The method of claim 12, which is provided through a data network.

14. The method of claim 13, wherein the data network is an internet.

15. A method of operating a gaming system, said method comprising:

causing at least one processor to execute a plurality of instructions stored in at least one memory device to operate with at least one display device and at least one input device to:

(a) display a plurality of different target sets, each of said target sets including a different plurality of selectable symbols;

(b) designate one of the selectable symbols of each target set as a target symbol for that target set, wherein a target symbol combination includes at least one target symbol from each of said target sets;

(c) enable a player to make a number of picks of said selectable symbols from said target sets;

(d) for each of the target sets, after receiving a pick of any one of said selectable symbols of said target set from the player, if the picked selectable symbol is not the target symbol of said target set and if said pick is not a last pick, indicate a relationship between said target symbol of said target set and the picked selectable symbol, wherein the indicated relationship includes a subset of the selectable symbols of said target set which includes said target symbol of said target set and which enables said target symbol for said target set to be picked with a next pick; and (e) if said target symbols of said target symbol combination are picked, display and provide an award, said award determined based on an order in which said target symbols of said target symbol combination are picked.

16. The method of claim 15, which includes causing the at least one processor to execute the plurality of instructions to operate with the at least one display device to display and provide an award if all of said target symbols of said target symbol combination are picked.

17. The method of claim 15, wherein said selectable symbols are picked until all of the target symbols of said target symbol combination are picked or until there are no picks remaining from said number of picks.

18. The method of claim 17, which includes causing the at least one processor to execute the plurality of instructions to operate with the at least one display device to display and provide an additional award if there are picks remaining from said number of picks after all of said target symbols of said target symbol combination are picked.

19. The method of claim 15, which is provided through a data network.

20. The method of claim 19, wherein the data network is an internet.

21. A method of operating a gaming system, said method comprising:

causing at least one processor to execute a plurality of instructions stored in at least one memory device to operate with at least one display device and at least one input device to:

(a) display a plurality of target sets, each said target set having a plurality of selectable symbols;

(b) designate one of said selectable symbols of each target set as a target symbol;

(c) enable a player to pick one of said selectable symbols from one of said target sets;

(d) determine whether the picked selectable symbol is said target symbol of said target set;

(e) if the picked selectable symbol is not said target symbol of said target set and there is at least one pick remaining:

(i) indicate a relationship between the picked selectable symbol and said target symbol of said target set, wherein the indicated relationship includes a subset of the selectable symbols of the target set which includes said target symbol of said target set and which enables said target symbol of said target set to be picked with a next pick, and (ii) repeat (c) to (e) until a number of picks of said selectable symbols are used or until each of said target symbols are picked; and (f) if a plurality of said target symbols are picked, display and provide an award based on an order in which said plurality of picked target symbols are picked.

22. The method of claim 21, which includes causing the at least one processor to execute the plurality of instructions to operate with the at least one display device and the at least one input device to enable the player to make a predetermined number of picks of said selectable symbols.

23. The method of claim 21, wherein the award includes one of an award value, an advancement to another target set, and a bonus game.

24. The method of claim 21, which is provided through a data network.

25. The method of claim 24, wherein the data network is an internet.

26. A method of operating a gaming system, said method comprising:

causing at least one processor to execute a plurality of instructions stored in at least one memory device to cause the at least one processor to operate with at least one display device and at least one input device to:

(a) display a plurality of target sets, said target sets each including a plurality of selectable numbers;

(b) designate one of said selectable numbers of each target set as a target number;

(c) enable a player to pick one of said selectable numbers of one of said target sets;

(d) after receiving a pick of one of said selectable numbers which is not said target number of said target set and if said pick is not a last pick, indicate a relationship between said target number of said target set and the picked selectable number, wherein the indicated relationship includes a subset of the selectable numbers of said target set which includes said target number of said target set and which enables said target number of said target set to be picked with a next pick; and (e) if a plurality of said target numbers are picked, display and provide an award based, at least in part, on an order in which said plurality of picked target numbers are picked.

27. The method of claim 26, which includes, if the picked selectable number is not said target number of said target set and if said pick is not the last pick, causing the at least one processor to execute the plurality of instructions to operate with the at least one display device to indicate whether the target number of said target set is higher, lower, one away from, or next to the picked selectable number.

28. The method of claim 26, which is provided through a data network.

29. The method of claim 28, wherein the data network is an internet.

30. A method of operating a gaming system, said method comprising:

causing at least one processor to execute a plurality of instructions stored in at least one memory device to operate with at least one display device and at least one input device to:

(a) display a plurality of different target sets, each of said target sets including a different plurality of selectable numbers;

(b) designate one of said numbers in each target set as a target number for that target set;

(c) enable a player to make a number of picks of said selectable numbers of said target sets;

(d) for each of the target sets, after receiving a pick of one of said selectable numbers in said target set from the player, if the picked selectable number is not said target number of said that target set and there is at least one pick remaining, indicate a relationship between said target number for said target set and the picked selectable number, wherein the indicated relationship includes a subset of the selectable numbers of said target set which includes said target number for said target set and which enables said target number for said target set to be picked with a next pick; and (e) if a plurality of the target numbers are picked, display and provide an award, said award having a numerical value, wherein the plurality of picked target numbers are digits of said numerical value and said numerical value is based on an order in which said picked target numbers are picked.

31. The method of claim 30, which includes causing the at least one processor to execute the plurality of instructions to operate with the at least one display device to arrange said digits of said numerical value in the order in which any picked target numbers are picked.

32. The method of claim 30, which is provided through a data network.

33. The method of claim 32, wherein the data network is an internet.

34. A method of operating a gaming system, said method comprising:

causing at least one processor to execute a plurality of instructions stored in at least one memory device to operate with at least one display device and at least one input device to:

(a) display a plurality of different target sets, each of said target sets including a different plurality of selectable symbols;

(b) for each of the target sets, designate one of said selectable symbols of said target set as a target symbol;

(c) enable a player to pick any one of said selectable symbols from said target sets;

(d) for each of the target sets, after receiving a pick of any one of said selectable symbols in said target set which is not said target symbol of said target set and if said pick is not a last pick, indicate a relationship between said target symbol of said target set and the picked selectable symbol, wherein the indicated relationship includes a subset of the selectable symbols of said target set which includes said target symbol of said target set and which enables said target symbol to be picked with a next pick; and (e) if a plurality of said target symbols are picked, display and provide an award based, at least in part, on an order in which said plurality of picked target symbols are picked.

35. The method of claim 34, which is provided through a data network.

36. The method of claim 35, wherein the data network is an internet.

* * * * *

UNITED STATES PATENT AND TRADEMARK OFFICE

CERTIFICATE OF CORRECTION

PATENT NO. : 8,727,861 B2
APPLICATION NO. : 12/098808
DATED : May 20, 2014
INVENTOR(S) : Megan N. Schlegel et al.

It is certified that error appears in the above-identified patent and that said Letters Patent is hereby corrected as shown below:

IN THE CLAIMS

In Claim 1, Column 13, Line 61, between “respective” and “sets” insert --target--.
In Claim 4, Column 14, Line 13, replace “the” with --a--.
In Claim 7, Column 14, Line 46, between “respective” and “sets” insert --target--.
In Claim 12, Column 15, Line 6, delete “and”.
In Claim 16, Column 15, Line 59, replace “an” with --the--.
In Claim 26, Column 16, Line 53, delete “cause the at least one processor to”.
In Claim 30, Column 17, Line 34, after “said” delete “that”.

Signed and Sealed this
Twenty-first Day of October, 2014

Michelle K. Lee

Michelle K. Lee
*Deputy Director of the United States Patent and Trademark Office*